US007458927B2

(12) United States Patent
Kauppila et al.

(10) Patent No.: US 7,458,927 B2
(45) Date of Patent: Dec. 2, 2008

(54) INTERFOLDER WITH PRE-FORMING TRANSFER ROLL

(75) Inventors: Greg Kauppila, Ashland, WI (US); Chad Ryczek, Washburn, WI (US); Dennis Couturier, Washburn, WI (US)

(73) Assignee: C.G. Bretting Manufacturing Co., Inc., Ashland, WI (US)

( * ) Notice: Subject to any disclaimer, the term of this patent is extended or adjusted under 35 U.S.C. 154(b) by 0 days.

(21) Appl. No.: 11/246,443

(22) Filed: Oct. 7, 2005

(65) Prior Publication Data

US 2007/0082801 A1 Apr. 12, 2007

(51) Int. Cl.
*B31F 1/10* (2006.01)

(52) U.S. Cl. ..... 493/435; 493/360; 493/403; 493/424; 270/39.01; 270/39.05; 270/32

(58) Field of Classification Search ..... 493/360, 493/403, 424, 425, 430, 433, 435; 270/39.06, 270/39.05, 39.01, 32
See application file for complete search history.

(56) References Cited

U.S. PATENT DOCUMENTS

| | | | | | |
|---|---|---|---|---|---|
| 843,781 | A | * | 2/1907 | Wheeler | 270/39.09 |
| 2,092,952 | A | | 9/1937 | Campbell | |
| 2,353,445 | A | | 7/1944 | Crafts | |
| 4,475,730 | A | | 10/1984 | Trogan | |
| 4,725,469 | A | * | 2/1988 | Summerfield | 428/43 |
| 4,765,604 | A | | 8/1988 | Trogan | |
| 4,778,441 | A | | 10/1988 | Couturier | |
| 4,917,665 | A | | 4/1990 | Couturier | |
| 5,088,707 | A | | 2/1992 | Stemmler | |
| 5,147,273 | A | * | 9/1992 | Rottmann et al. | 493/349 |
| 5,310,398 | A | * | 5/1994 | Yoneyama | 493/430 |
| 6,010,122 | A | | 1/2000 | Weber | |
| 6,024,685 | A | | 2/2000 | Kirsch | |
| 6,165,116 | A | | 12/2000 | White | |
| 6,179,764 | B1 | | 1/2001 | Eckert | |

* cited by examiner

*Primary Examiner*—Hemant M Desai
(74) *Attorney, Agent, or Firm*—Reinhart Boerner Van Beuren P.C.

(57) ABSTRACT

An interfolding apparatus including a knife roll, a first interfolding roll, a second interfolding roll, and a transfer roll. The knife roll cuts sheets from a stream of web material issuing from a source in a downstream direction. The first interfolding roll is positioned downstream of the knife roll and receives the sheets. The first interfolding roll rotates in a first direction and the second interfolding roll rotates in a second direction. The first and second interfolding rolls interfold the sheets with additional sheets received by the second interfolding roll. A transfer roll is positioned between the knife roll and the first interfolding roll. The transfer roll has a non-uniform surface configuration and rotates in the second direction and receives the sheets from the knife roll, forms a bend in each of the sheets, and transfers the formed sheets to the first interfolding roll.

14 Claims, 7 Drawing Sheets

INTERFOLDER WITH PRE-FORMING TRANSFER ROLL

BACKGROUND

The present invention relates to interfolding apparatuses, and more specifically to the transfer of sheets onto interfolding rolls of the interfolding apparatuses.

Various combinations and types of rolls can be present in an interfolding apparatus. A typical interfolding apparatus includes at least two interfolding rolls, at least one knife or cutting roll, and at least one feed roll for pulling streams of web material into the interfolding apparatus. The web material is generally cut at or near the knife rolls and is eventually transferred to a nip between the interfolding rolls.

The succession of sheets entering the nip is such that a middle portion of a reference sheet on a first interfolding roll enters the nip at the same time as trailing and leading edges of downstream and upstream sheets, respectively, positioned on a second interfolding roll. The leading and trailing edges are positioned adjacent a tucker of the second interfolding roll. The tucker pushes or tucks the middle portion of the reference sheet into a gripper (either mechanical or vacuum) of the first interfolding roll as the tucker and gripper pass through the nip. The gripper receives the middle portion and the trailing and leading edges from the tucker, folds the middle portion capturing the leading and trailing edges within the fold, and conveys and releases the fold to an adjacent side of a stack of interfolded sheets being built below the interfolding rolls. As the interfolding rolls continue rotation, a gripper of the second interfolding roll receives a middle portion of the upstream sheet and the associated leading and trailing edges from a tucker of the first interfolding roll, folds the middle portion capturing the associated leading and trailing edges, and conveys and releases the fold to the adjacent side of the stack of interfolded sheets.

This process is repeated in an alternating fashion between the first and second interfolding rolls. To insure that the associated leading and trailing edges are properly folded within the middle portion of the sheet being folded, it is important to control the position of the leading and trailing edges on the interfolding rolls, and more particularly relative to the tucker of the interfolding roll.

Known interfolders attempt to maintain the position of the leading and trailing edges during interfolding by providing vacuum ports on the interfolding rolls. However, during interfolding as described above, a tucker forces a middle portion of a sheet into a recess of an opposite gripper. The length of sheet forced within the gripper must be compensated for by stretch or rupture of the sheet or by movement of one, or both, of the leading and trailing edges of the sheet being folded. In some cases, this will alter the position of the leading edge (i.e., draw it closer to the middle portion) such that the leading edge is pulled from the downstream gripper which performed the previous fold. In other cases, this will alter the position of the trailing edge such that the trailing edge is pulled from its respective vacuum port. In some extreme cases, tucking a middle portion of a sheet within an opposite gripper will cause the trailing edge of the sheet being folded to become freed from the gripper or the leading edge to become freed from the vacuum port. Where an edge moves or becomes freed, the edge is not tucked tightly within the fold and a visible discontinuity in the stack could result. In the case of a freed edge, interruption of the interfolding could occur.

SUMMARY

Some embodiments of the invention provide an interfolding apparatus and a method of interfolding sheets of web material that improves the control of the position of the sheets on the interfolding rolls during interfolding.

In one embodiment, the invention provides an interfolding apparatus including a knife roll, a first interfolding roll, a second interfolding roll, and a transfer roll. The knife roll is rotatable about an axis and is operable to cut sheets from a stream of web material issuing from a source in a downstream direction. The first interfolding roll is positioned downstream of the knife roll and is adapted to receive the sheets. The first interfolding roll is rotatable in a first direction. The second interfolding roll is rotatable in a second direction and is disposed adjacent to the first interfolding roll to define a nip therebetween. The first and second interfolding rolls are rotatable to interfold the sheets with additional sheets received by the second interfolding roll. A transfer roll is positioned between the knife roll and the first interfolding roll. The transfer roll has a non-uniform surface configuration and is rotatable in the second direction. The transfer roll is operable to receive the sheets from the knife roll, to form a bend in each of the sheets received from the knife roll, and to transfer the formed sheets to the first interfolding roll.

In another embodiment, the invention provides a method of interfolding sheets of web material. The method includes issuing web material in a downstream direction from a source, cutting with a knife roll the stream of web material into sheets, transferring each sheet to a transfer roll, forming with the transfer roll a bend in the middle portion of each sheet, transferring each formed sheet to an interfolding roll, and interfolding the formed sheet on the interfolding roll with at least one other sheet from an adjacent interfolding roll.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
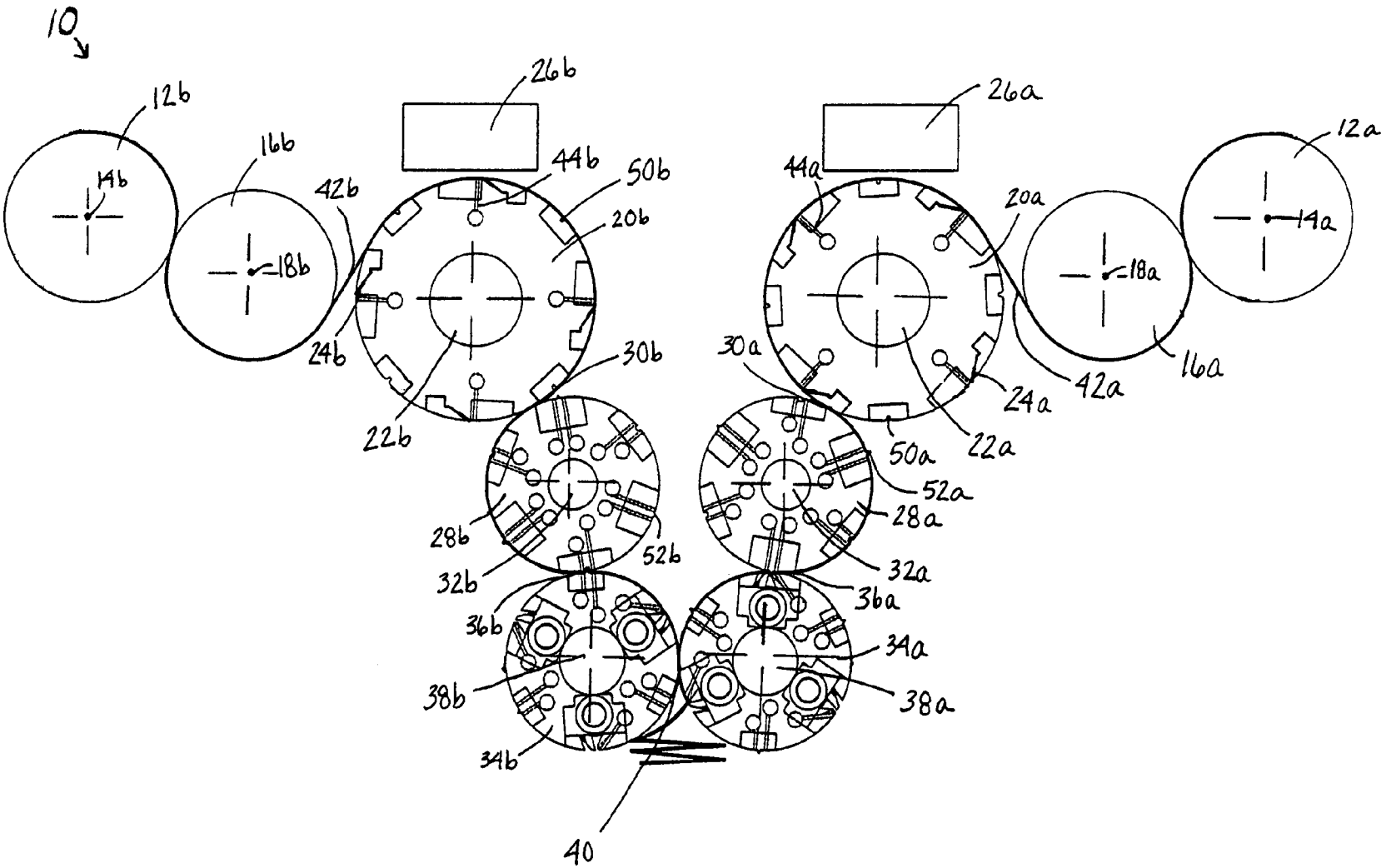
FIG. 1 is a side view illustrating an interfolding apparatus of one embodiment of the present invention.

An interfolder, or interfolding apparatus 10, of one embodiment of the present invention is illustrated in FIG. 1. The interfolding apparatus 10 includes a set of outer pull rolls 12*a*, 12*b* that are mounted for rotation about axes 14*a*, 14*b*. A set of inner pull rolls 16*a*, 16*b* are adjacent the outer pull rolls 12*a*, 12*b* and are mounted for rotation about axes 18*a*, 18*b*. Knife rolls 20*a*, 20*b* are mounted for rotation about axes 22*a*, 22*b*. The knife rolls 20*a*, 20*b* contain blades 24*a*, 24*b* that contact respective stationary anvil bars 26*a*, 26*b*. Transfer rolls 28*a*, 28*b* are adjacent knife rolls 20*a*, 20*b* to form nips 30*a*, 30*b*, respectively. The transfer rolls 28*a*, 28*b* are mounted for rotation about axes 32*a*, 32*b*. Interfolding rolls 34*a*, 34*b* are positioned adjacent the transfer rolls 28*a*, 28*b* to form nips 36*a*, 36*b*, respectively. The interfolding rolls 34*a*, 34*b* are mounted for rotation about axes 38*a*, 38*b*. The interfolding rolls 34*a*, 34*b* are adjacent to one another to form a nip 40.

The interfolding apparatus 10 is capable of interfolding streams of continuously flowing web material 42*a*, 42*b*. The interfolding apparatus 10 can be divided into two sides that are mirror images of one another. Therefore, only a side "b" will be described in detail, with the understanding that the other side "a" performs the same functions, only that the movement is opposite to that of side "b". For example, clockwise rotation of a roll on side "b" would mean that the complementary roll on the side "a" would have counterclockwise rotation.

Figure 2:
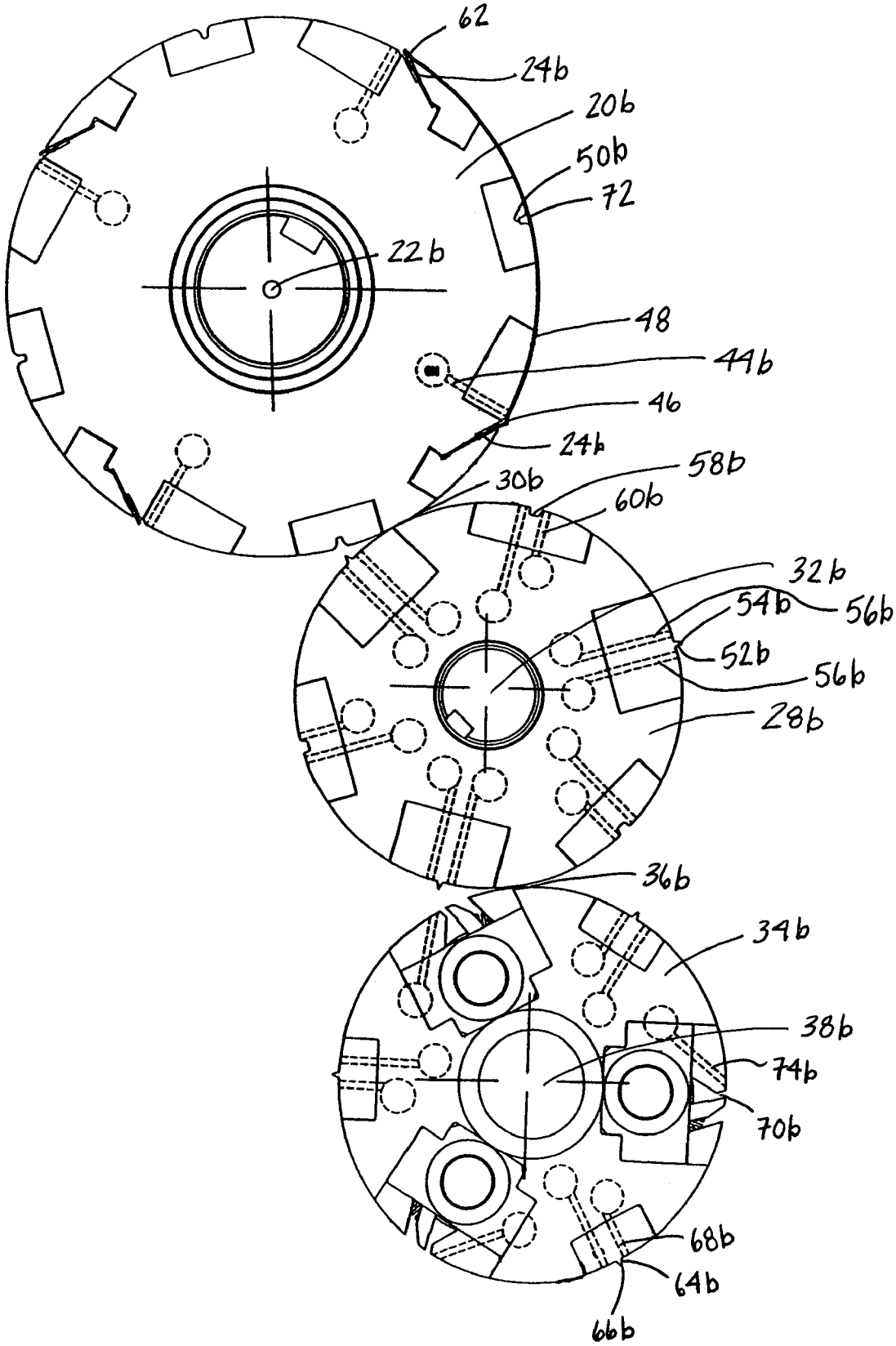
FIG. 2 is an enlarged side view of a portion of the interfolding apparatus shown in FIG. 1, illustrating a sheet on a knife roll.

As more clearly shown in FIG. 2, the knife roll 20*b* includes a vacuum port 44*b* adjacent each individual blade 24*b*. In the embodiment illustrated in FIGS. 1-7, the knife roll 20*b* includes four blades 24*b* with four corresponding vacuum ports 44*b*. The distance between blades 24*b* corresponds to the length of a sheet 48 cut from the stream of web material 42*b*. In other words, the sheet 48 extends across a circumferential length that is equal to 14 of the circumference of the knife roll 20*b*. A circumferential length is defined as the length of the portion of the roll circumference between leading and trailing edges of the sheet assuming that the roll radius is continuous and disregarding any non-uniformities on the roll surface, such as protuberances or grooves. The knife roll 20*b* also includes four grooves 50*b* positioned between adjacent sets of blades 24*b*.

The forming blades 52*b* of transfer roll 28*b* protrude from the periphery of transfer roll 28*b* and end at a point 54*b*. Vacuum ports 56*b* are located on opposite sides of the forming blade 52*b*. The transfer roll 28*b* also includes grooves 58*b* positioned between adjacent sets of forming blades 52*b*. Vacuum ports 60*b* are located on either side of each respective groove 58*b*.

Figure 7:
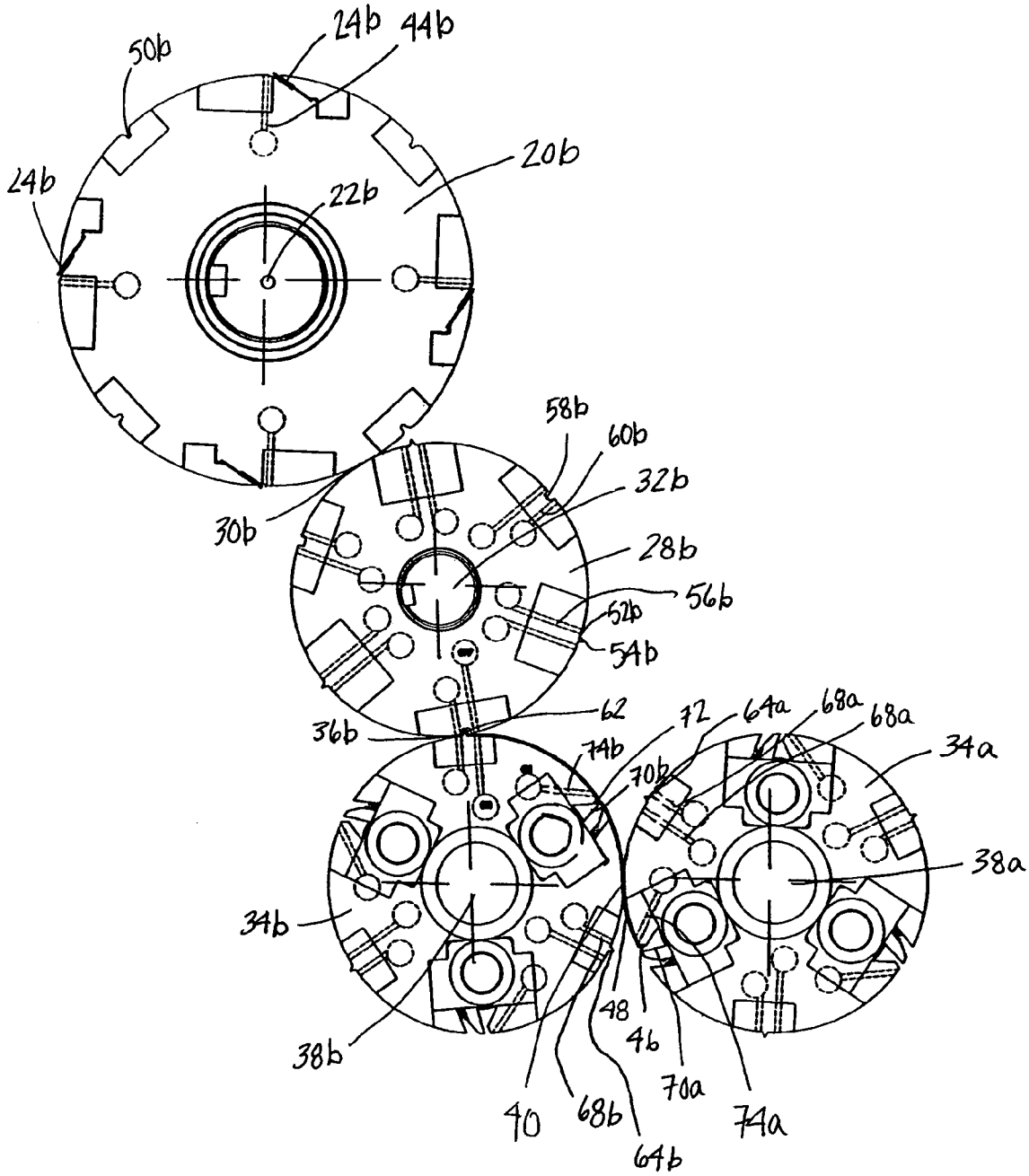
FIG. 7 is a side view of a portion of the interfolding apparatus shown in FIG. 1, illustrating the sheet being interfolded between the interfolding roll and an adjacent interfolding roll.

The tuckers 64*b* of the interfolding roll 34*b* are similar to the forming blades 52*b* of transfer roll 28*b* in that the tuckers 64*b* protrude from the periphery of the interfolding roll 34*b* and end at a point 66*b*. Vacuum ports 68*b* are located on both sides of the tucker 64*b*. As shown in FIG. 7, the interfolding roll 34*b* also includes grippers 70*b* positioned between adjacent sets of tuckers 64*b*. The grippers 70*b* can include their own vacuum ports 74*b* located adjacent the gripper 70*b*. Tucker 64*b* of interfolding roll 34*b* is received within groove 58*b* of transfer roll 28*b*, and tucker 64*b* is received within gripper 70*a* during rotation of the transfer roll 28*b* and interfolding rolls 34*a*, 34*b*.

The forming blades 52*b* are received within grooves 50*b* to pre-form the sheet 48 with a bend prior to creasing the sheet 48 with a gripper 70*b*. In some embodiments, the pre-forming operation of the forming blades 52*b* and grooves 50*b* does not leave a crease mark in the sheet 48 if the sheet 48 were to be removed from the interfolding apparatus 10 after being preformed by the forming blades 52*b* and the grooves 50*b*. In these embodiments, a crease forms at the middle portion 72 of sheet 48 when the gripper 70*b* of interfolding roll 34*b* pinches the bent portion of the sheet 48, as discussed in more detail below. In other embodiments, a crease can be formed by the transfer roll 28*b*.

As shown in FIG. 1, in operation, streams of web material 42*a*, 42*b* are fed from separate paper feeds (not shown). As illustrated in FIG. 1, the streams of web material 42*b*, 42*a* are transferred to outer pull rolls 12*b*, 12*a*, respectively. Referring now to the "b" side of the interfolding apparatus, outer pull roll 12*b* is rotating in a clockwise direction about axis 14*b* to draw the stream of web material 42*b* toward the inner pull roll 16*b*. The inner pull roll 16*b* is rotating in a counterclockwise direction about axis 18*b* such that the first stream of web material 42*b* can be transferred to the knife roll 20*b*. Other methods and arrangements are available for transferring streams of web material to the knife rolls, as is well known to one of ordinary skill in the art.

As shown in FIG. 2, when transferred to the knife roll 20*b*, a sheet 48 is cut from the first stream of web material 42*b* when the blade 24*b* contacts the anvil 26*b*. Other methods and arrangements are available for cutting streams of web material into sheets on a knife roll, as is well known to one of ordinary skill in the art. For clarity, only one sheet 48 is shown. In general, for the illustrated embodiment, adjacent sheets of web material cut by the knife roll 20*b* would be present on the upstream and downstream sides of the sheet 48. The knife roll 20*b* successively cuts sheets from the first stream of web material 42*b* with the blade 24*b*. The vacuum port 44*b* is operable to hold the leading edge 46 of the sheet 48 onto the knife roll 20*b*.

FIG. 2 illustrates a leading edge 46 of the sheet 48 aligned with blade 24*b* and held against the periphery of the knife roll 20*b* by vacuum port 44*b*. The trailing edge 62 of sheet 48 is aligned with a cutting edge of the blade 24*b*. Initially, the sheet 48 is not received within the groove 50*b* on the knife roll 20*b*. However, upon rotation of the knife roll, the groove 50*b* receives a forming blade 52*b* of the adjacent transfer roll 28*b*.

Figure 3:
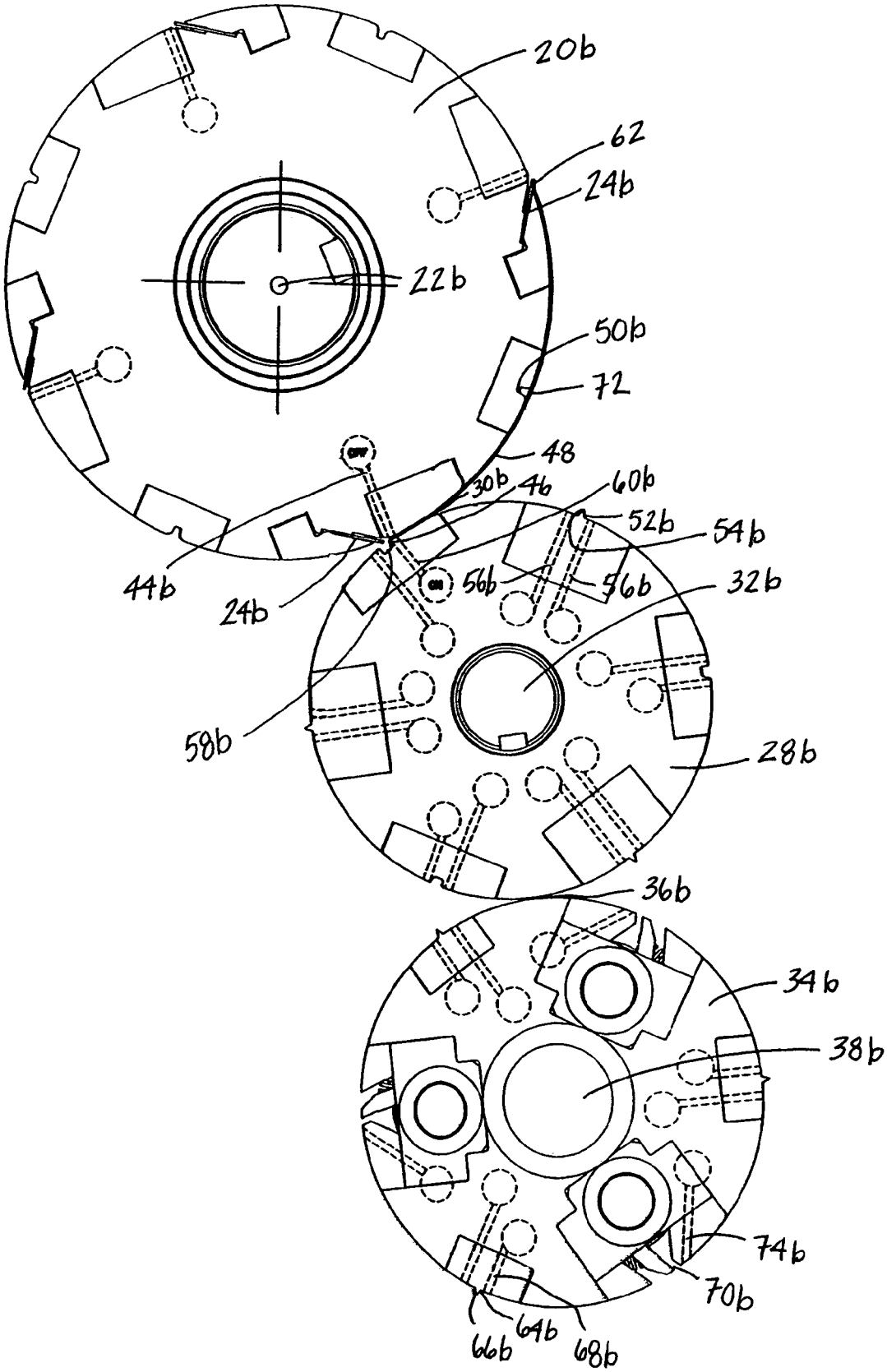
FIG. 3 is a view similar to FIG. 2, illustrating a leading edge of the sheet being transferred to a transfer roll from the knife roll.

FIG. 3 illustrates the sheet 48 downstream from the first position shown in FIG. 2. As the knife roll 20*b* rotates clockwise, and the transfer roll 28*b* rotates counterclockwise, the sheet 48 begins to transfer from the knife roll 20*b* to the transfer roll 28*b*. More specifically, the leading edge 46 of the sheet 48 is drawn by vacuum port 60*b* adjacent the groove 58*b* of the transfer roll 28*b*. The vacuum ports 60*b* hold the leading and trailing edges 46, 62 of the sheet 48 against the transfer roll 28*b* and partially over the groove 58*b*. The suction force of vacuum port 60*b* is stronger than the suction force of vacuum port 44*b* at that point in rotation of the transfer roll 28*b* and knife roll 20*b* such that the sheet 48 is released from vacuum port 44*b* and held by vacuum port 60*b*.

Figure 4:
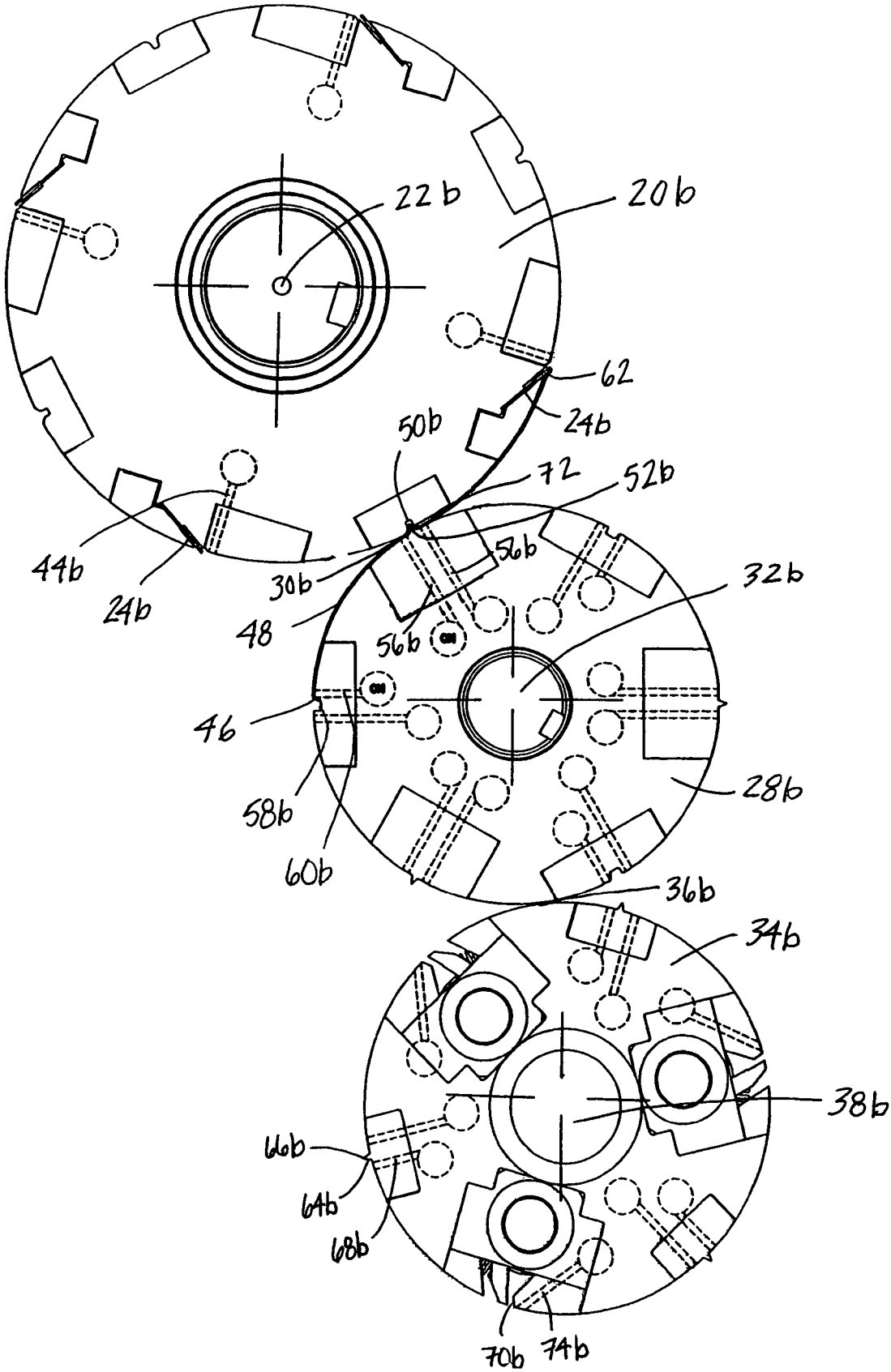
FIG. 4 is a view similar to FIG. 2, illustrating a middle portion of the sheet being formed into a bend between the knife roll and the transfer roll.

As illustrated in FIG. 4, the knife roll 20*b* and the transfer roll 28*b* have progressed in rotation such that the forming blade 52*b* of the transfer roll 28*b* is inserted into the groove 50*b* of the knife roll 20*b* and the sheet 48 is in a position downstream from the position shown in FIG. 3. The insertion of the forming blade 52*b* into the groove 50*b* of the knife roll 20*b* forms a bend in the sheet 48 at the middle portion 72 such that the sheet 48 becomes pre-formed. The bend in the sheet 48 is held against the periphery of the transfer roll 28*a* due to the vacuum force and the positioning of vacuum ports 56*b* on the transfer roll 28*b*. The sheet 48 changes from having a first peripheral length on the knife roll 20*b* to having a second peripheral length on the transfer roll 28*b* that is shorter than the first peripheral length.

The second peripheral length of the sheet 48 on the transfer roll 28*b* is shorter than the first peripheral length of the sheet 48 on the knife roll 20*b* because as the forming blade 52*b* is inserted into the groove 50*b*, the sheet 48 is transferred across the protruding surface of the forming blade 52*b*. Since the forming blade 52*b* protrudes past the uniform radial surface of the roll, the peripheral length of the sheet 48 is shorted by the added distance required to cover the forming blade 52*b*. The circumference of the transfer roll 28*b* is less than ¾ of the circumference of the knife roll 20*b*. In other embodiments, the circumference of the transfer roll 28*b* is not equally divisible by the sheet length. For example, the circumference of the knife roll 20*b* is equal to four sheet lengths, but the circumference of the transfer roll 28*b* is not equally divisible by 3 sheets. Instead, the circumference of the transfer roll 28*b* is equal to a number between 2 and 3 sheet lengths.

Figure 5:
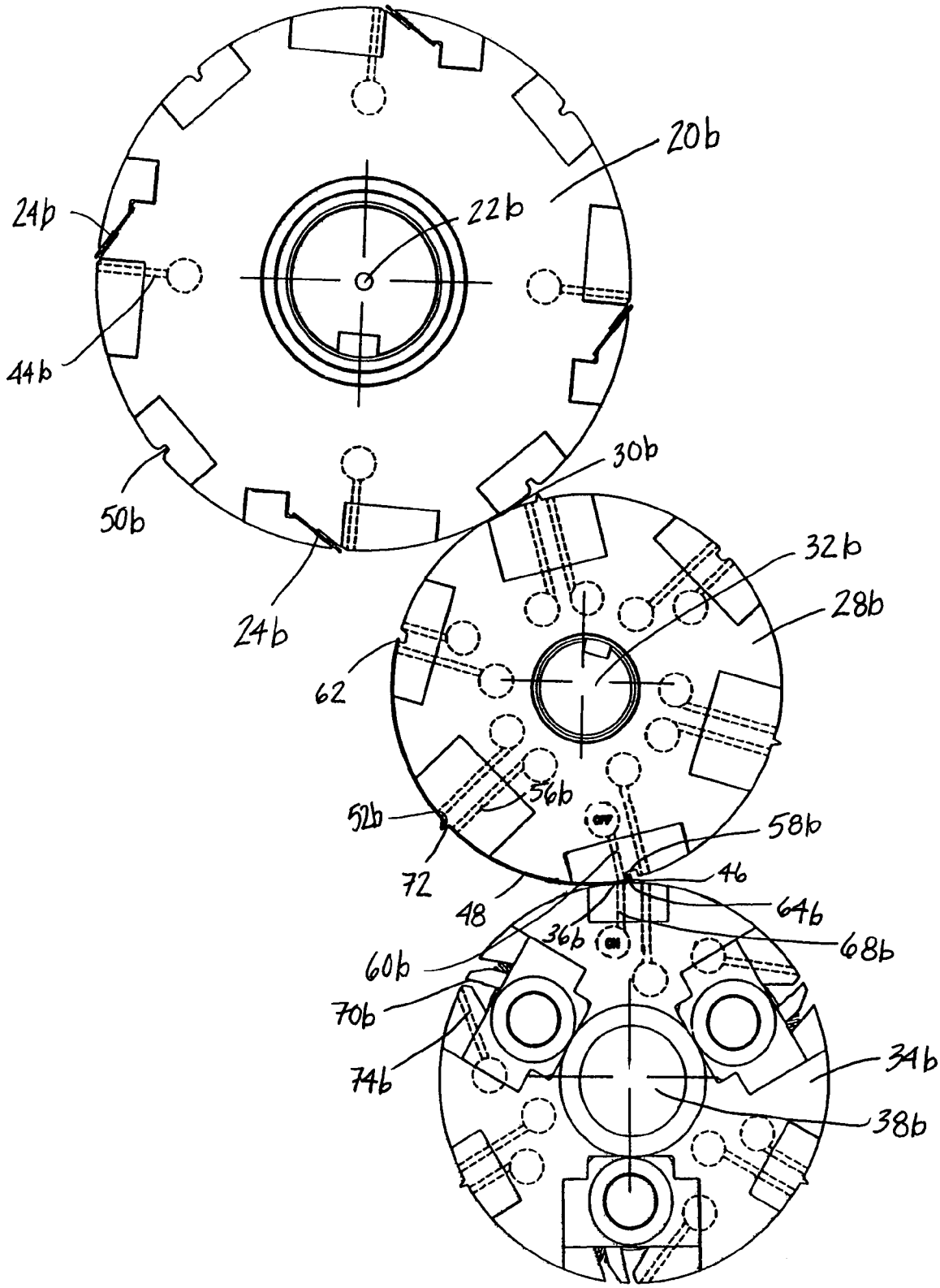
FIG. 5 is a view similar to FIG. 2, illustrating the leading edge of the sheet being transferred to an interfolding roll from the transfer roll.

FIG. 5 illustrates the sheet 48 downstream from the position of the sheet 48 shown in FIG. 4. As the transfer roll 28*b* rotates in a counterclockwise manner, the groove 58*b* of the transfer roll 28*b* now partially receives the tucker 64*b* of the interfolding roll 34*b*. The vacuum force of vacuum port 74*b* of interfolding roll 34*b* is greater than the vacuum force of vacuum port 56*b* of the transfer roll 28*b* such that the leading edge 46 of the sheet 48 that is held in the adjacent groove 58*b* of the transfer roll 28*b* is released from the vacuum port 56*b* and held by vacuum port 74*b*. The leading edge 46 is positioned along the tucker 64*b* and adjacent the point 66*b* of the tucker 64*b*.

Figure 6:
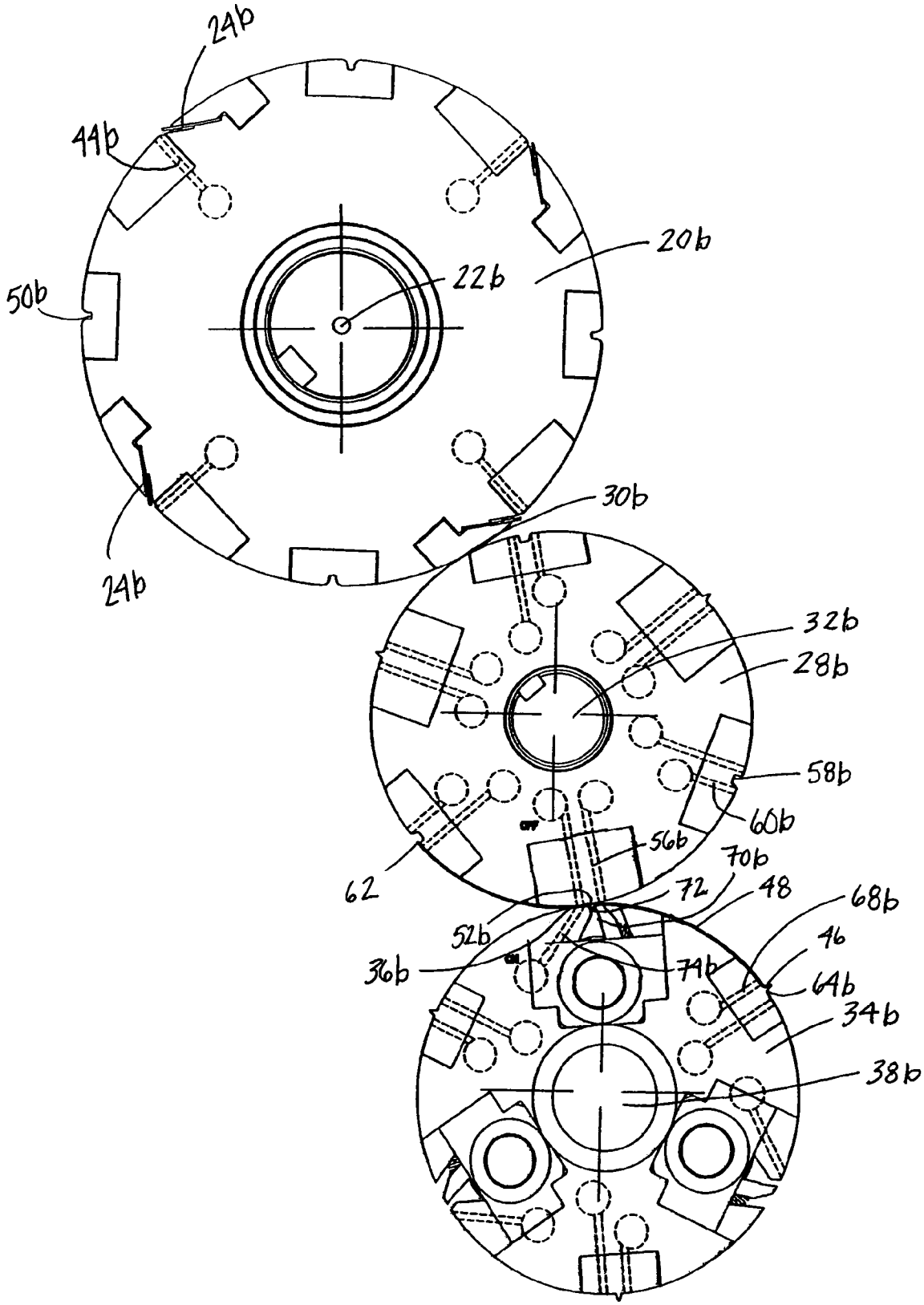
FIG. 6 is a view similar to FIG. 2, illustrating the formed middle portion of the sheet being transferred into a gripper of the interfolding roll from the transfer roll.

FIG. 6 illustrates the sheet 48 downstream from the position of the sheet 48 shown in FIG. 5. The transfer roll 28*b* and the interfolding roll 34*b* have rotated to a position in which the forming blade 52*b* of the transfer roll 28*b* and the bent portion of the sheet 48 are inserted into the gripper 70*b* of the interfolding roll 34*b*. The suction of the vacuum port 74*b* of the gripper 70*b* at that position of rotation of the transfer roll 28*b* and the interfolding roll 34*b* is greater than the suction of the two vacuum ports 56*b* surrounding the forming blade 52*b* of the transfer roll 28*b* such that the middle portion 72 of the sheet 48 will be released from vacuum port 56*b* and held against the vacuum port 74*b* of the interfolding roll 34*b*. The vacuum port 74*b* helps to maintain the middle portion 72 of the sheet 48 in a fixed position relative to the periphery of the interfolding roll 34*b*. The trailing edge 62 will be ironed against the periphery of the interfolding roll 34*b* due to the transfer nip 36*b* defining a tight roll gap that is operable to iron the transferring sheet 48 as the transfer roll 28*b* and the interfolding roll 34*b* rotate together.

The transfer roll 28*b* functions to pre-form sheets of material such that the circumferential length of the sheet along the transfer roll is that same as the circumferential length of the sheet along the interfolding roll to obtain a more accurate fold. This is accomplished by creating a bend in the sheet, and transferring the sheet from the transfer roll to the interfolding roll of the same size such that the bent portion is inserted within the gripper. Because the bent portion is positioned within the gripper, the sheet no longer moves on the interfolding roll to compensate for the amount of sheet forced within the gripper by the opposing tucker. This allows for more accurate control of the positions of the leading and trailing edges of the sheets on the interfolding rolls.

FIG. 7 illustrates the sheet 48 downstream from the position of the sheet 48 shown in FIG. 6. The leading edge 46 of the sheet 48 is positioned near the gripper 70*a* of the adjacent interfolding roll 34*a*. If the downstream and upstream sheets were shown on both interfolding rolls 70*a*, 70*b*, the leading edge 46 of sheet 48 would still be received by the gripper 70*a*, but a pre-formed middle portion of a downstream sheet from interfolding roll 70*a* would be between the leading edge 46 of sheet 48 and the gripper 70*a* with its pre-formed middle portion 72 positioned within gripper 70*a*. As interfolding roll 34*b* rotates clockwise and interfolding roll 34*a* rotates counterclockwise, the gripper 70*b* receiving the middle portion 72 of sheet 48 is aligned to receive tucker 64*a* of interfolding roll 34*a*. If the downstream and upstream sheets were shown on both rolls, the gripper 70*b* would also receive the trailing edge of the downstream sheet from interfolding roll 34*a* and the leading edge of the upstream sheet from interfolding roll 34*a* as tucker 64*a* is inserted into gripper 70*b*.

As sheets continue to progress through the interfolding apparatus 10, the interfolding rolls 34*a*, 34*b* will continue to interfold sheets of material in the manner described.

What is claimed is:

1. An interfolding apparatus for interfolding first sheets of a first web of sheet material moving in a downstream direction along a first web path with second sheets from a second web of sheet material moving in a downstream direction along a second web path, with each of the first sheets having a leading edge and a trailing edge substantially spaced an unfolded length of the first sheets from one another along the web path and a middle portion disposed along the web path substantially halfway along the unfolded length of the first sheets between the leading and trailing edges of the first sheets, the apparatus comprising:

a knife roll for cutting the first sheets from the first web of sheet material, first and second interfolding rolls for interfolding the first and second sheets with one another, and a transfer roll for transferring the first sheets from the knife roll to the first interfolding roll and forming a pre-bend in the middle portion of the first sheets in cooperation with the knife roll;

the knife roll being rotatable about a first axis in a first direction, the transfer roll being operatively connected to be rotatable in a second direction opposite the first direction about a second axis extending substantially parallel to the first axis, the first interfolding roll being operatively connected to be rotatable in the first direction about a third axis extending substantially parallel to the first and second axes, and the second interfolding roll being operatively connected to be rotatable in the second direction about a fourth axis extending substantially parallel to the first, second and third axes;

the knife roll and transfer roll having respective peripheries thereof with portions of their respective peripheries defining respectively a knife-roll-portion of the web path and a transfer-roll-portion of the web path cooperatively disposed and rotationally timed such that the first sheets travel sequentially from the knife-roll-portion to the transfer-roll-portion of the web path with their respective leading edges disposed downstream from their respective trailing edges at substantially the unfolded length from their respective trailing edges along the knife roll;

the periphery of the knife roll having a pre-forming groove therein and the transfer roll having a corresponding pre-forming blade thereof configured and operatively connected to the knife roll in timed rotation therewith for pressing the middle portion of each first sheet into the pre-forming groove in the knife roll, to thereby pre-form a bend into the middle portion of each sheet;

the first interfolding roll including a gripper therein for grasping each first sheet along the pre-formed bend and forming an interfold along the pre-formed bend in each first sheet, whereby the pre-formed bend facilitates interfolding of the first and second sheets.

2. The apparatus of claim 1, wherein the transfer roll includes a plurality of vacuum ports, and wherein a first vacuum port of the plurality of vacuum ports retains the leading edge of the sheet and wherein a second vacuum port of the plurality of vacuum ports retains the trailing edge of the sheet.

3. The apparatus of claim 1, wherein the first interfolding roll includes a plurality of vacuum ports, and wherein a third vacuum port of the plurality of vacuum ports retains the leading edge of the sheet, and wherein a fourth vacuum port of the plurality of vacuum ports retains the trailing edge of the sheet.

4. The apparatus of claim 1, wherein each first sheet extends across an unfolded circumferential length on the knife roll and extends across a second circumferential length on the transfer roll, wherein the first circumferential length is greater than the second circumferential length, the second circumferential length being substantially equal to the unfolded length minus a length of the pre-formed bend.

5. The apparatus of claim 1, wherein the knife roll is disposed adjacent the transfer roll to define a nip therebetween, wherein each first sheet is transferred directly from the knife roll to the transfer roll.

6. The apparatus of claim 1, wherein the transfer roll is disposed adjacent to the first interfolding roll to define a nip therebetween, wherein each first sheet is transferred directly from the transfer roll to the first interfolding roll.

7. The apparatus of claim 6, wherein the nip between the transfer roll and the first interfolding roll defines a tight roll gap operable to iron the transferred first sheet as the transfer roll and first interfolding roll rotate together.

8. The apparatus of claim 1, wherein the knife roll, the transfer roll, and the first interfolding roll include vacuum ports operable to transfer the first sheets from the knife roll to the transfer roll and to transfer sheets from the transfer roll to the first interfolding roll.

9. A method of interfolding, first sheets of a first web of sheet material moving in a downstream direction along a first web path with second sheets from a second web of sheet material moving in a downstream direction along a second web path, with each of the first sheets having a leading edge and a trailing edge substantially spaced an unfolded length of the first sheets from one another along the web path and a middle portion disposed along the web path substantially halfway along the unfolded length of the first sheets between the leading and tailing edges of the first sheets, using an interfolding apparatus having a knife roll for cutting the first sheets from the first web of sheet material, first and second interfolding rolls for interfolding the first and second sheets with one another, and a transfer roll for transferring the first sheets from the knife roll to the first interfolding roll and forming a pre-bend in the middle portion of the first sheets in cooperation with the knife roll;

with the knife roll being rotatable about a first axis in a first direction, the transfer roll being operatively connected to be rotatable in a second direction opposite the first direction about a second axis extending substantially parallel to the first axis, the first interfolding roll being operatively connected to be rotatable in the first direction about a third axis extending substantially parallel to the first and second axes, and the second interfolding roll being operatively connected to be rotatable in the second direction about a fourth axis extending substantially parallel to the first, second and third axes;

with the knife roll and transfer roll also having respective peripheries thereof with portions of their respective peripheries defining respectively a knife-roll-portion of the web path and a transfer-roll-portion of the web path cooperatively disposed and rotationally timed such that the first sheets travel sequentially from the knife-roll-portion to the transfer-roll-portion of the web path with their respective leading edges disposed downstream from their respective trailing edges at substantially the unfolded length from their respective trailing edges along the knife roll;

the periphery of the knife roll having a pre-forming groove therein and the transfer roll having a corresponding pre-forming blade thereof configured and operatively connected to the knife roll in timed rotation therewith for pressing the middle portion of each first sheet into the pre-forming groove in the knife roll, to thereby pre-form a bend into the middle portion of each sheet;

the first interfolding roll including a gripper therein for grasping each first sheet along the pre-formed bend and forming an interfold along the pre-formed bend in each first sheet, whereby the pre-formed bend facilitates interfolding of the first and second sheets;

the method comprising:

issuing a stream of first web material in the downstream direction along the first web path from a source;

cutting the stream of the first web material with the knife roll into the first sheets;

transferring each sheet from the knife roll to the transfer roll;

pre-forming with the transfer roll a bend in the middle portion of each first sheet;

transferring each pre-formed first sheet to the first interfolding roll; and interfolding the pre-formed first sheet on the first interfolding roll with at least one second sheet from the second interfolding roll.

10. The method of claim 9, further comprising extending each first sheet across a first unfolded circumferential length on the knife roll; and extending each first sheet across a shorter, second circumferential length on the transfer roll, the second circumferential length being substantially the unfolded length minus a length of the pre-formed bend.

11. The method of claim 10, further comprising extending each sheet across a third circumferential length on the first interfolding roll that is the same as the second circumferential length.

12. The method of claim 9, wherein transferring each pre-formed sheet to an interfolding roll includes transferring a leading edge of the formed sheet onto the transfer roll to the first interfolding roll.

13. The method of claim 9, wherein pre-forming a bend includes forcing the middle portion of a sheet within the pre-forming groove of the knife roll with the pre-forming blade of the transfer roll.

14. The method of claim 9, further comprising receiving the pre-formed bend of the first sheet in the gripper of the first interfolding roll and inserting a tucker of the second interfolding roll into the pre-formed bend of the first sheet for facilitating insertion of the pre-formed bend into the gripper of the first interfolding roll.

* * * * *